United States Patent [19]

Newman, Sr. et al.

[11] Patent Number: 4,572,217

[45] Date of Patent: Feb. 25, 1986

[54] FIRE-SAFE CIGARETTE HOLDER SYSTEM

[76] Inventors: William E. Newman, Sr., 207 Doncaster Rd., Joppa, Md. 21085; Paul D. Newman, 7 Nacelle Rd., Baltimore, Md. 21220

[21] Appl. No.: 545,697

[22] Filed: Oct. 26, 1983

[51] Int. Cl.[4] ..... A24F 13/08; A24F 13/14; A24F 13/16; A24F 13/18

[52] U.S. Cl. ..... 131/175; 131/349

[58] Field of Search ..... 131/175, 349

[56] References Cited

U.S. PATENT DOCUMENTS 2,625,163 1/1953 Jones et al. ..... 131/175

4,386,616 6/1983 Rosen ..... 131/175

*Primary Examiner*—V. Millin

*Assistant Examiner*—H. Macey

*Attorney, Agent, or Firm*—John F. McClellan, Sr.

[57] ABSTRACT

A system for providing fire safety from burning ends of cigarettes includes a perforate tube with end caps, one of which has for receiving a cigarette there-through an aperture with a plurality of slits radiating from it; a cigarette so-received is held with burning end located in the perforate tube by a plurality of longitudinal ribs integrally protrusive along the perforate tube interior wall; the perforate tube perforations are arrayed in a plurality of circumferential rows; row to row spacing helps determine burning time of an unpuffed cigarette, which is extinguished after a short interval if unpuffed.

1 Claim, 6 Drawing Figures

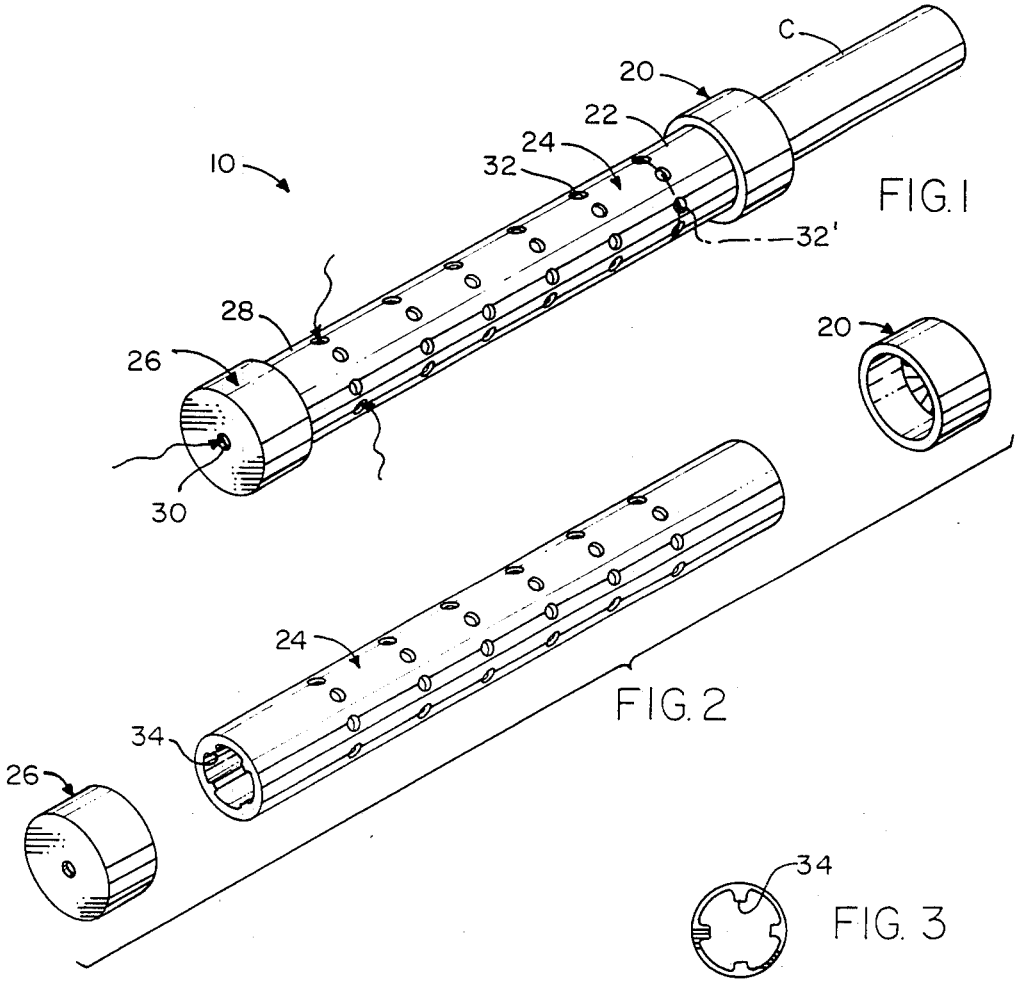
FIG. 1
FIG. 2
FIG. 3
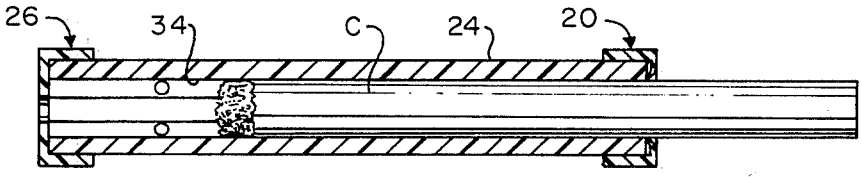
FIG. 4
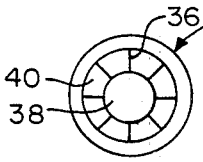
FIG. 5
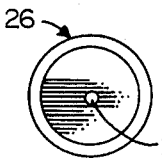
FIG. 6

FIRE-SAFE CIGARETTE HOLDER SYSTEM

FIELD OF THE INVENTION

This invention relates generally to tobacco smoking accessories and particularly to cigarette holders.

SUMMARY OF THE INVENTION

A principal object of this invention is to produce a cigarette holder that is safe and renders cigarettes safer to smoke.

One of the common causes of death by fire is smoking cigarettes in bed; ignition of the bedding can cause fumes that axphyxiate victims, even before flames appear. An object of this invention is to prevent this.

Aircraft fires attributable to ignition of plastic furnishings by dropped cigarette carelessly set aside have caused deaths. An object of this invention is to reduce, if not eliminate, such accidents.

Further objects of this invention are to provide a cigarette holder making cigarettes not only safer to smoke in bed at home, and in aircraft, but also in hospitals, nursing homes, motels, boats and ships, and without taking away the enjoyment of smoking.

Yet further objects of the invention are to provide a cigarette holder that guards against impact, so that a cigarette dropped will not ignite anything, protecting rugs, chairs, tables, floors and the like, and not dropping ashes.

Still a further object is to provide a cigarette holder which can put a cigarette out in two minutes if the cigarette is not puffed in that time.

And further objects are to provide a cigarette holder as described that will fit any conventional cigarette, filter tip type or not; that will not stain fingers, and that is economical, durable and easily cleaned.

And yet further objects are to provide a holder as described which will hold a cigarette firmly under all circumstances, that will extinguish it beofe it gets too short to hold firmly, that will not itself burn, and that is simple, easy and foolproof to use, and is attractive in appearance.

BRIEF DESCRIPTION OF THE DRAWINGS

The above and other objects and advantages of this invention will become more readily apparent on examination of the following description, including the drawings in which like reference numerals refer to like parts.

FIG. 1 is a perspective view of the invention in use;

FIG. 2 is an exploded perspective view;

FIG. 3 is an end elevational view on an enlarged scale of a central part of the invention;

FIG. 4 is a longitudinal sectional view;

FIG. 5 is an end elevational view on an enlarged scale of a first end cap of the invention; and FIG. 6 is an end elevational view on an enlarged scale of a second end cap of the invention.

DETAILED DESCRIPTION

FIG. 1 shows the invention in embodiment 10. A cigarette "C" protrudes co-axially from a first end cap 20 on the first end 22 of the invention, in position for being engaged by the mouth of a user. The burning end of the cigarette is inside the tubular middle portion 24 of the invention between the first cap 20 and a second end cap 26 on the second end 28 of the invention.

Air (arrows) is drawn in through hole 30 in the second end cap, which is preferably coaxial to promote uniform burning, and through a plurality of perforations 32 in the middle portion 24.

Preferably the perforations are equally spaced in circumferential rows 32' around the middle portion 24, and the rows are equally spaced from each other, to help provide predictable times of cigarette extinguishment if the cigarette is not puffed, as discussed below.

FIGS. 2, 3 and 4 show further features of the invention, integral ribs 34 extending parallel with and equally spaced from each other along the interior wall surface of the middle portion 24, from end to end. The ribs space a cigarette, "C", FIG. 4 to promote uniform burning.

The ribs are preferably four in number. Both end caps 20, 26 make a light frictional fit between the inside surface and the middle portion 24.

FIG. 5 shows the regular array of slits or serrations 36 extending in first end cap 20 radially outward from the coaxial cigarette receiving circular apertures 38, to impart flexibility.

Eight or more slits in the membrane 40 are preferred for proper holding.

FIG. 6 shows the inside of the second end cap 26, and hole 30.

In operation, the invention is used as follows:

(a) first end cap 20 is detached and slipped over the unlighted cigarette, down to the mouth piece of the cigarette or equivalent length if there is none;

(b) the cigarette is then lighted in the usual way and the lighted end is thrust into the middle portion 24 a distance permitting the first end cap to be slipped onto the middle portion, where the fit retains it and the cigarette;

(c) the second end cap 26 is preferably already in place on the second end of the middle portion, if not, it is replaced, and may serve as a grip while the cigarette is smoked, or the first end cap may be held.

After the cigarette is smoked, it may be withdrawn and discarded; the end caps may be removed to drop any ash accumulated.

During smoking of the cigarette, if no puff is taken within about a two minute interval in which the perforations and ribs promote burning, as when the invention is laid or dropped on a table, bed, ashtray or other rest, the cigarette is extinguished, and without injury to the surroundings in the interim.

This surprisingly effective function results from the dimensions of the configuration and the material, which does not transfer heat rapidly.

For use with customary diameter and length cigarettes (longer lengths can be accommodated in longer embodiments) the dimensions advantageously may be substantially as follows:

Middle portion:
- length: 2¾ inch (68 mm)
- diameter outside: 7/16 inch (11 mm)
- diameter rib to rib: 0.300 inch (7 mm)
- wall thickness: 0.028 inch (0.7 mm)
- rib radial protrusion: 0.040 inch (1 mm)
- rib width: 1/16 inch (15 mm)
- diameter of perforation: 1/16 inch (1.5 mm)
- on-center spacing of perforations and of rows of perforations: 3/16 inch (4.6 mm)

End caps:
- length: ¼ inch (6 mm)
- diameter, outside ½ inch (13 mm)
- diameter of hole in first end caps: ¼ inch (6 mm)

diameter of hole in second end cap: 1/16 inch (1.5 mm)

end wall thickness, first end cap: 0.002 to 0.005 inch (0.1 to 0.12 mm)

If a cigarette snugly fit the inner wall of a tube, even with an open end, the cigarette would extinguish immediately after a puff.

In this invention, the clearances indicated between cigarette and inner wall, and the perforation or hole diameters and hole spacings, particularly row-to-row, determine how long the invention will permit an unpuffed cigarette to burn, before oxygen starvation. The drawings depict only the principal, not exact dimensions, which may be varied to suit, the more clearance and ventilation, the longer the interval.

It should be noted that the greater diameter of the end caps provides a fire-safety recess around the middle portion when the invention is laid down. Standing the invention on end will simply extinguish a cigarette faster.

Material for the fire safe cigarette holder of this invention may be "Teflon" for all three parts, "Teflon" being non-combustible, and heat resistant within the range of temperatures produced by smoking cigarettes, and a registered trademark polytetrafluoroethylene.

The middle portion can be simply a cut-off length of extrusion; the end caps can be injection-molded. Other inward protrusions can be employed within the spirit of the invention, in place of the continuous ribs.

This invention is not to be construed as limited to the particular forms disclosed herein, since these are to be regarded as illustrative rather than restrictive. It is, therefore, to be understood that the invention may be practiced within the scope of the claims otherwise than as specifically described.

We claim:

1. A system providing for fire-safe guarding of burning ends of cigarettes comprising: a tubular middle portion, a first end cap on the tubular middle portion, means on the first end cap for receiving a said cigarette therethrough and holding said cigarette with burning end in said tubular middle portion, means in said tubular middle portion for coacting to promote burning of said cigarette for limited intervals, a second end cap with a hole therethrough, on said tubular middle portion, said means for coacting to promote burning of a cigarette for limited intervals comprising the tubular middle portion having a plurality of perforations and a plurality of inward protrusions for engaging a cigarette, said means for receiving a said cigarette comprising an aperture-defining membrane with a plurality of slits radially outward therefrom.

* * * * *